United States Patent [19]

Villanueva

[11] Patent Number: 4,710,122

[45] Date of Patent: Dec. 1, 1987

[54] MACHINE FOR MANUFACTURING FLAT BODIES IN A CONTINUOUS LINE

[76] Inventor: Eliseo H. Villanueva, c/ Cid, s/n - Polígono Torrubero, Museros (Valencia), Spain

[21] Appl. No.: 837,589

[22] Filed: Mar. 7, 1986

[51] Int. Cl.[4] ..... B28B 5/04

[52] U.S. Cl. ..... 425/259; 198/465.2; 198/795; 425/261; 425/347; 425/351

[58] Field of Search ..... 425/256–260, 425/233, 347, 351, 261, 253–255; 198/465.2, 795; 271/5

[56] References Cited

U.S. PATENT DOCUMENTS

| | | | |
|---|---|---|---|
| 1,706,874 | 3/1929 | De Journo | 425/347 X |
| 1,925,050 | 8/1933 | Jagdmann et al. | 425/258 X |
| 2,999,579 | 9/1961 | Kostrzewa | 198/795 |
| 3,010,371 | 11/1961 | Riedel et al. | 198/465.2 X |
| 3,221,781 | 12/1965 | Forsstrom | 198/465.2 X |
| 3,315,778 | 4/1967 | Kendall, Sr. et al. | 198/465.2 |
| 3,523,344 | 8/1970 | Huber et al. | 425/258 X |
| 3,779,684 | 12/1973 | Folkes | 425/233 |
| 3,912,253 | 10/1975 | Jarman | 271/5 |
| 3,955,613 | 5/1976 | Lund | 198/795 X |

FOREIGN PATENT DOCUMENTS

| | | | |
|---|---|---|---|
| 2518689 | 11/1976 | Fed. Rep. of Germany | 198/465.2 |
| 145925 | 11/1980 | Japan | 198/465.2 |

*Primary Examiner*—Richard L. Chiesa
*Attorney, Agent, or Firm*—McGlew and Tuttle

[57] ABSTRACT

The invention relates to a machine for manufacturing flat bodies in a continuous linear process. This is attained by the intermittent forward movement of the moulds on a closed circuit static runway, passing through the various operative steps for forming the pieces. The runway defines a rectangular trajectory and the moulds are square with bevelled vertices forming vertical channels for the actuation of centering elements. The moulds cover the totality of the circuit with the exception of two spaces at the diagonally opposed angles. Each straight section is provided with a pusher facing a buffer for the simultaneous and combined action until each mould reaches the end of the circuit. At a point of the circuit there is a fixed hopper beneath which there reciprocally moves a carriage bearing a metering hopper. Once the pieces have been formed they are removed by a pneumatic extractor having a multiple suction head.

4 Claims, 4 Drawing Figures

MACHINE FOR MANUFACTURING FLAT BODIES IN A CONTINUOUS LINE

SUMMARY OF THE INVENTION

The object of the present invention is to provide the market with a novel machine for manufacturing tiles or any other flat body for use in construction, the various operative steps of which, that is filling the moulds, pressing, extracting the formed pieces, cleaning the moulds and other operations, are performed in accordance with a continuous linear working process, formed of a closed circuit static runway on which the moulds forming the pieces are intermittently moved forward, passing through the various operative steps for forming the pieces.

Thus, the machine for manufacturing flat bodies in a continuous linear process is characterised in that it comprises a channeled sliding static runway for the moulds, while the elements for filling, pressing, extracting formed pieces, cleaning the moulds and others, disposed on sections of the runway, pass.

The said runway is comprised of rectilinear sections determining a squared rectangular trajectory, mainly combined with a plurality of substantially quadrangular moulds.

The said moulds are characterised in that their vertices are bevelled proportioning, a better guiding between the channeling collateral guide sections, and constituting, close to the moulds, vertical angular channels enabling operation of feelers which control the centering of each mould, mainly in the field of action of the press.

Further, the surface of each of the said moulds is a sub-multiple of the surface of the closed circuit, the moulds covering the totality of the circuit with the exception of the spaces disposed respectively at two diagonally opposed angles.

One end of each rectilinear section of the circuit is provided with a mould pusher which is joined to a buffer disposed at the tail end of each section, the pushers and the buffers of the parallel sections of the circuit functioning alternatively two-by-two, intermittently feeding each mould into the circuit.

Each pusher is actuated by a hydraulic or pneumatic cylinder, the stroke of which is equal to or greater than the corresponding dimension of the mould, and each buffer is actuated by a pneumatic cylinder combined with a pressure regulator, the buffer and the antagonic pusher being moved simultaneously for receiving the corresponding mould to the end of stroke thereof.

Said end of stroke of the mould will determine the resilient retraction of the buffer, contrary to the adjusted pressure of its cylinder, in the return of which a microswitch functions ordering the return of the corresponding pusher and the synchronisation of the remaining pushers and buffers.

Further, the machine is characterised in that a linear section of the circuit, above the linear passage of the moulds, is provided with at least one fixed hopper, and moving reciprocally beneath it a carriage having a flat surface acting in its displacement as a closure plate for the fixed hopper.

The runway has, projected below the discharge opening of the metering hopper, at least one fixed bridge plate for each hopper.

Each bridge plate has a blank part and a part provided with grated openings, these latter coinciding with the spaces of the mould for forming the pieces. The blank part of the bridge plate constitutes the means for closing the discharge opening of the metering hopper of the carriage, and the part containing the grated openings constitutes the means for distributing the material fed to the piece forming spaces in the reciprocal movements of the metering hopper of the carriage, precisely in combination with the raising and lowering of the bottom of the piece forming spaces provided in each mould.

Each of the moulds which are intermittently displaced by the fixed path, contains spaces in which the pieces will be formed, and the inner face of each space is closed by a steel bottom, the contour of which can be provided or not with a retainer which accompanies the mould in its displacement.

When the mould is inoperative, the bottom of each space moves vertically, due to the conventional action of hydraulic elements. The movements of the bottom control the filling of the spaces for the formation of the pieces, the vibration of the material deposited in the moulds, the extraction of the pressed and formed pieces, and the cleaning of the mould bottoms.

In order to elevate the bottoms, they are joined to elevating elements, by electromagnetic means.

Furthermore, the machine is characterised in that the pneumatic device for extracting the finished pieces, disposed at the outlet of each press, has a vacuum-effect multiple suction head for the pieces, precisely partitioned internally by baffles which distribute the vacuum effect according to the pieces to be extracted.

Such suction head is joined to an air distributor and to a vertical elevating table, below the maximum outlet point of the extractor carriage. The end elevation of the said scissors type table is controlled and contracts the suction head which, by means of the microswitch, orders the pieces to be placed on the table, established by the action of the distributor.

For a better understanding of the invention, a set of drawings is accompanied to this specification without constituting a limitation of the special characteristics thereof.

DESCRIPTION OF THE PREFERRED EMBODIMENT

Figure 1:
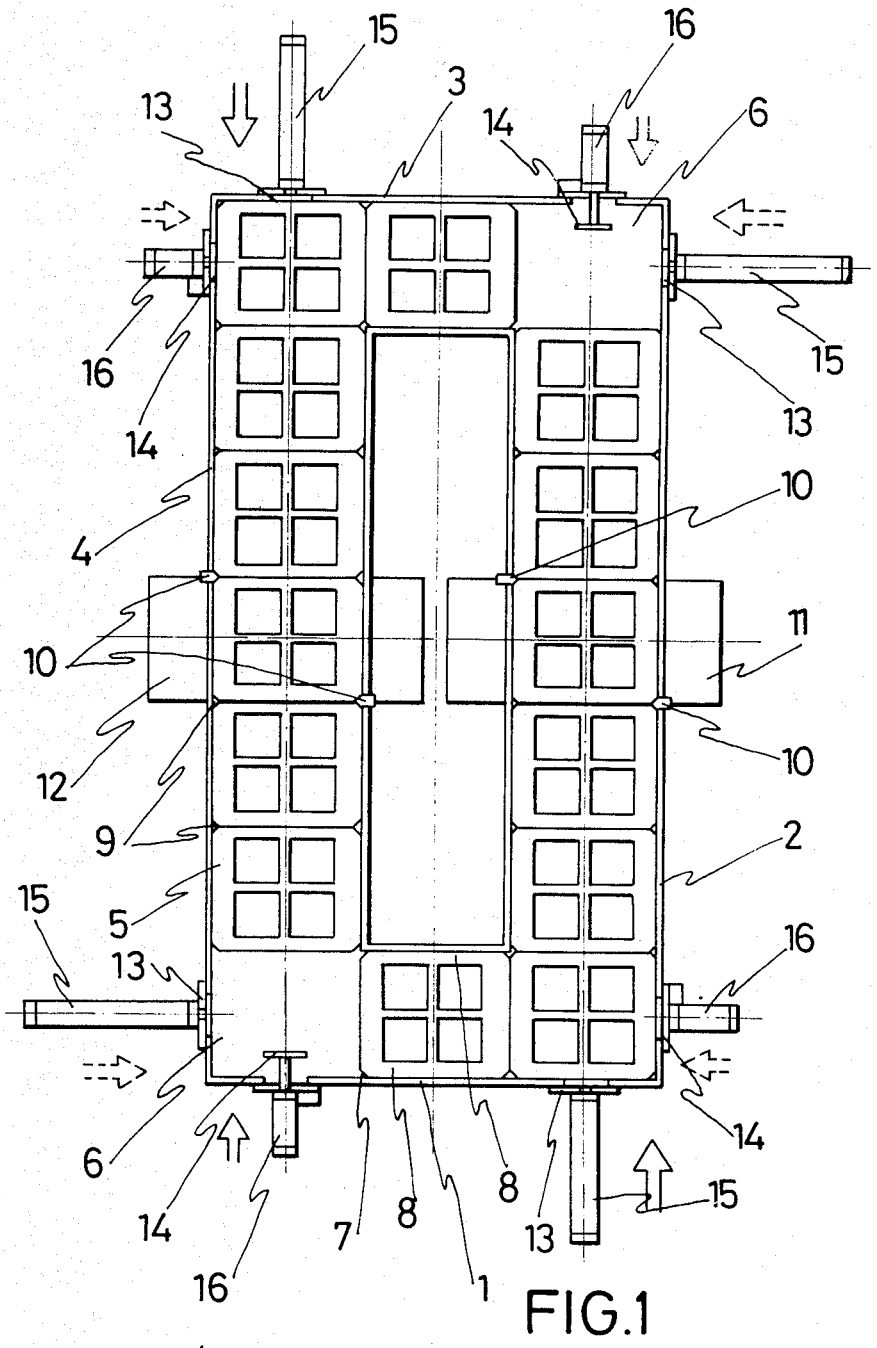
FIG. 1 is a top plan view of a runway of the machine in accordance with the present invention.

FIG. 1 is a plan view of the static runway of the machine for manufacturing flat bodies in a continuous cycle. It can be observed that this runway is composed of rectilinear sections determining a squared rectangular trajectory. The said runway channelises the displacement in a closed circuit of a plurality of moulds which occupy the totality of the circuit, with the exception of the spaces of two diagonally opposed angles of the runway. The moulds are substantially quadrangular and their vertices are beveled, being perfectly guided between the channeling collateral guide sections of the runway, said beveled vertices determining, close to the moulds, vertical angular channels enabling the operation of feelers which control the centering of each mould, said feelers being placed in the field of action of the press. At the head of each section of the circuit, the runway is provided with a mould pusher joined to a buffer disposed at the tail end of each section, so that the pushers and the buffers of the parallel sections of the runway function alternatively two by two, producing the intermittent advance of each mould into the circuit. Each pusher is actuated by a hydraulic or pneumatic cylinder, having a stroke equal to or greater than the corresponding dimension of a mould, whilst each buffer is actuated by a pneumatic cylinder, joined to a pressure regulator, the buffer and the opposite pusher being moved simultaneously for receiving the corresponding mould to its end of stroke, at which moment the resilient retraction of the buffer is determined, contrary to the pressure of the cylinder, which return activates a microswitch which will order the return of the corresponding pusher and the synchronisation of the remaining pushers and buffers.

Figure 2:
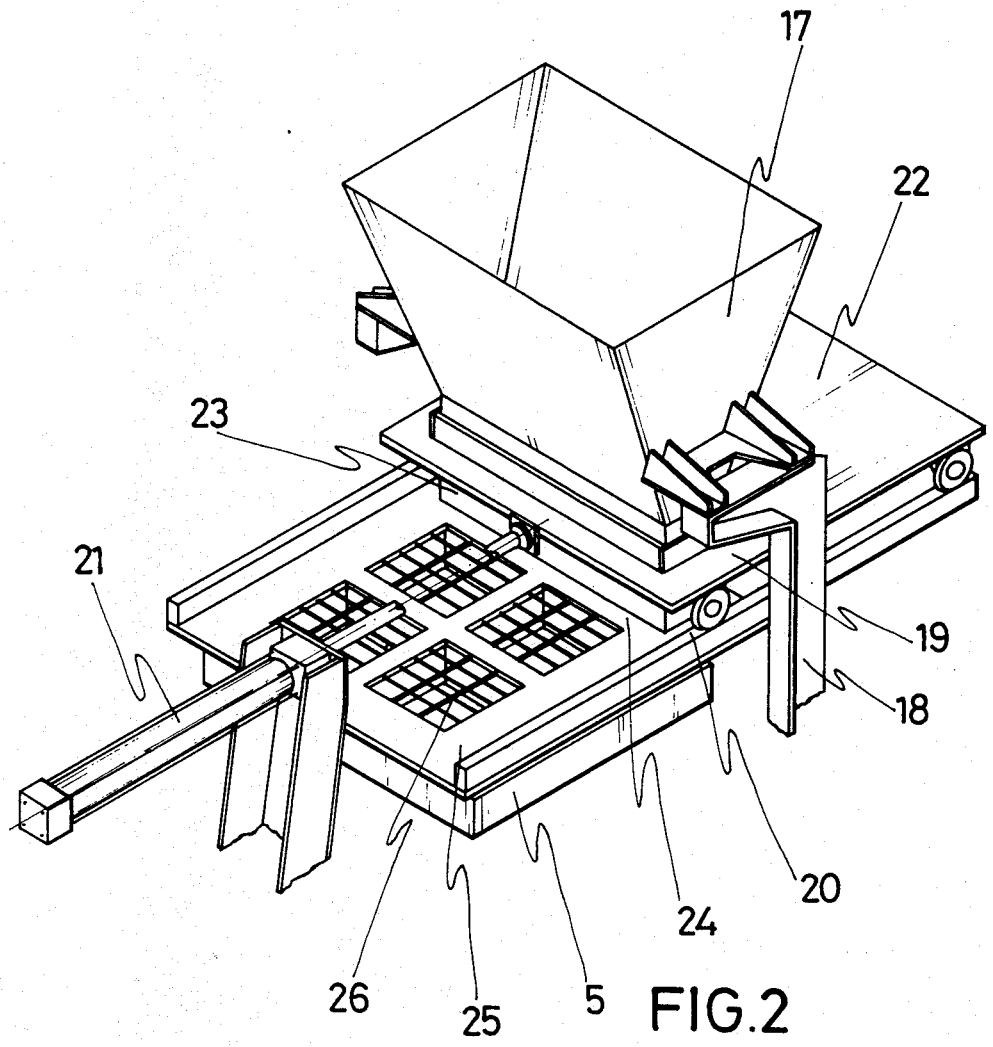
FIG. 2 is a perspective view of the material metering device of the present invention.

FIG. 2 is a perspective view of the material metering device to the piece forming mould. It can be observed that the metering device has a fixed hopper mounted on columns disposed at the sides of the runway. Beneath the fixed hopper is placed a carriage reciprocally displaceable by the action of a pneumatic cylinder, which carriage is provided superiorly with a flat surface which closes, during displacement, the outlet of the fixed hopper, whilst the platform is provided with the inlet of a metering or collecting hopper mounted on the carriage and displaceable therewith. The outlet of the said metering hopper of the carriage is closed by the blank part of a bridge plate mounted on the runway. The said plate has grated openings coinciding with the spaces of the moulds, which are disposed beneath the plate for loading the material, so that the metering hopper in its movements feeds the material to the spaces of the moulds through the grated holes of the bridge plate and this is effected in combination with the raising and lowering of the bottom of the mould spaces.

Figure 3:
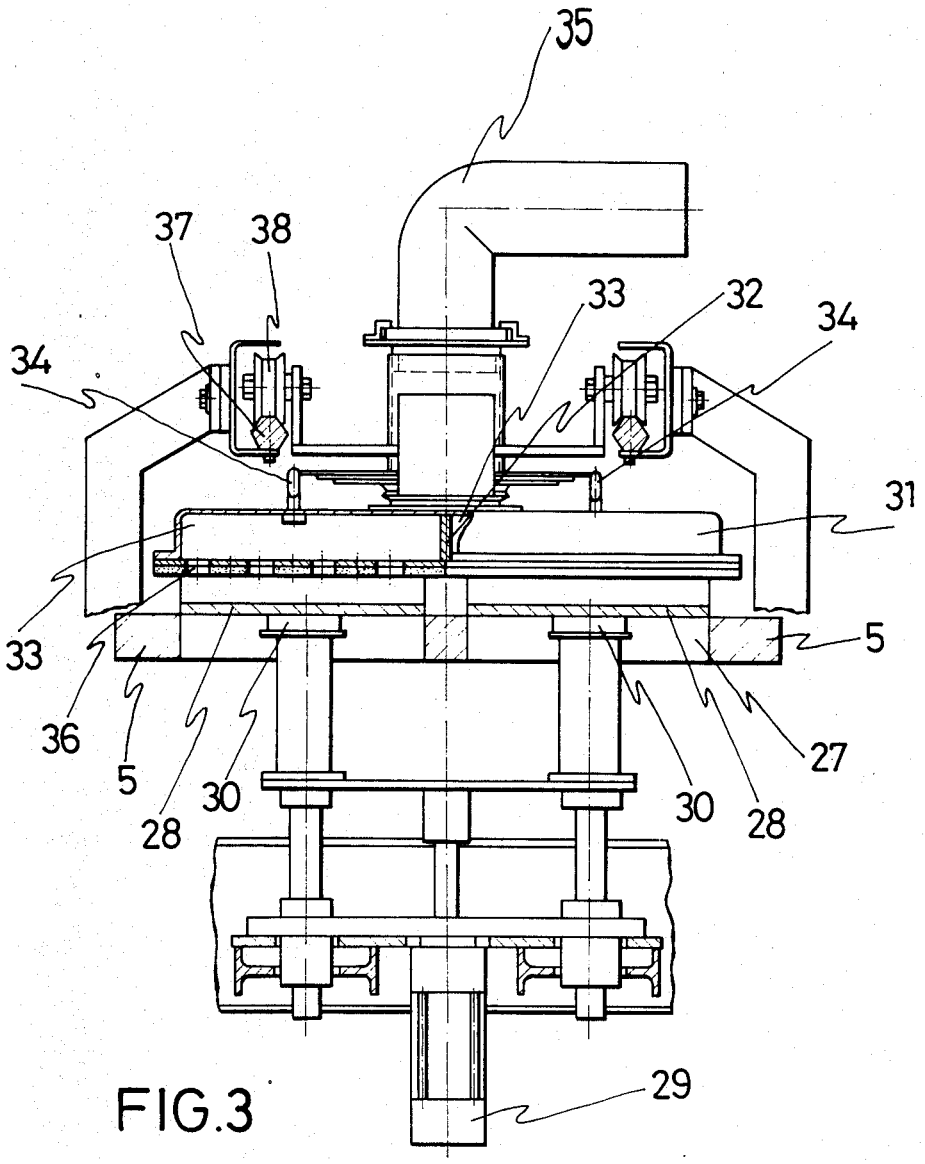
FIG. 3 is a side elevational view of a device for extracting the formed pieces in accordance with the present invention.

FIG. 3 represents a side elevational view of the device for extracting the formed pieces, according to a cross section thereof. It can be observed that it has a vacuum effect multiple suction head of the formed pieces. The said head is partitioned internally, distributing the suction air according to the pieces to be extracted, and functions in combination with an air distributor and a vertical elevating table which receives the formed pieces. The extracting device is capable of moving transversally on the mould channeling runway, wherefore it incorporates upper bearings which are mounted on hexagonal guides and convey the pieces extracted from the mould to the receiving platform disposed at the end of stroke of the extracting device. The extracting head, in its position for extracting the pieces, is disposed on the mould, the piece forming spaces of which are inferiorly closed by a steel bottom. Said bottom, when the mould is inoperative, effects vertical movements due to the action of hydraulic elements, the support columns of which, presenting their ends joined to the bottom, are provided with electromagnetic means, so that the steel bottom is joined to said elevating elements, to be displaced in an ascending movement, for extracting the pieces, to the field of action of the extracting head, to thereafter descend to its normal position. This ascending and descending movement of the bottoms is produced both in the extraction operation from the bottoms as well as in the operations of filling the mould, vibration of the deposited material, and cleaning of the said bottoms.

Figure 4:
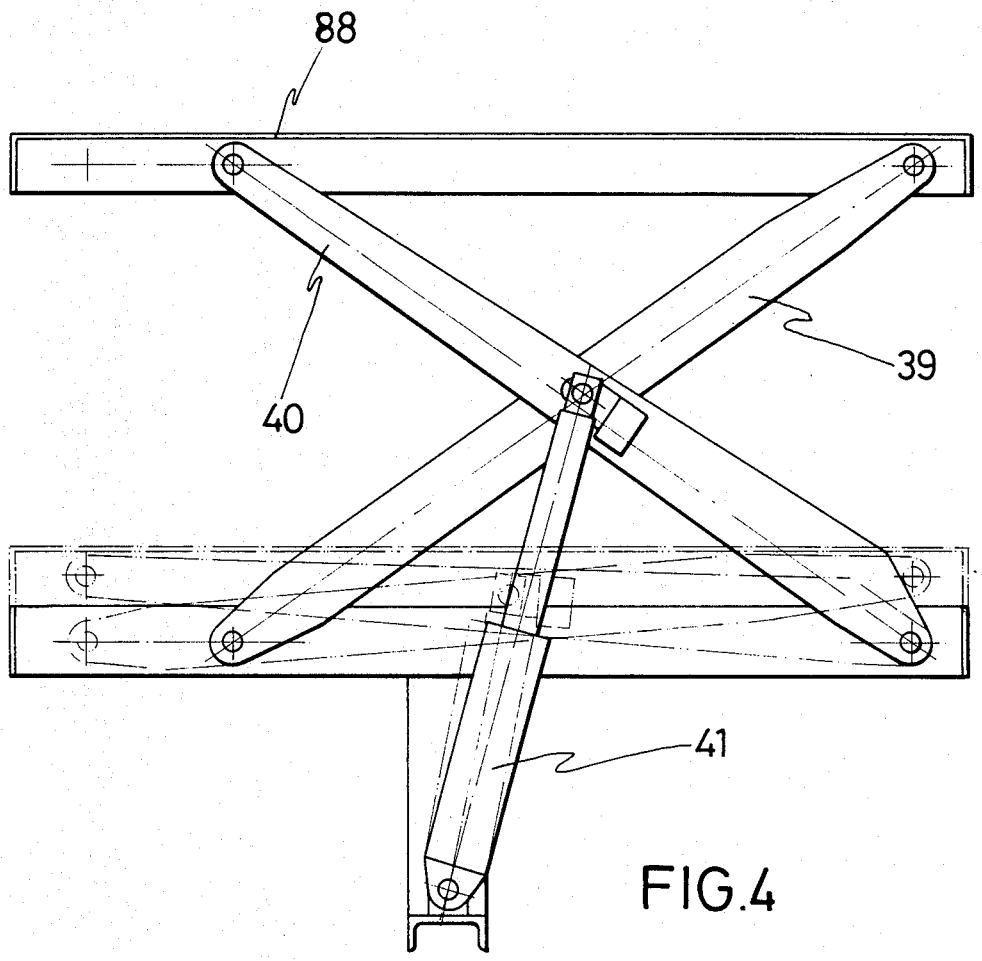
FIG. 4 is a side elevational view of a table for receiving the formed pieces in accordance with the present invention.

FIG. 4 represents a side elevational view of the table receiving the formed pieces. The said table is enabled with a vertical elevating and lowering movement, wherefore the base and the table are joined by interengaging levers forming a type of scissors actuated by a pneumatic or hydraulic cylinder, enabling the arms thereof to be unfolded or folded. When the arms are unfolded, the table is elevated at the highest point of which it contracts the suction head bearing the formed pieces which, by means of the microswitch, orders the pieces to be placed on the table, established by the action of the air distributor.

Referring to the drawings, the various parts constituting the object of the invention will now be described.

The machine for manufacturing flat bodies such as tiles or the like in a continuous process and in a closed circuit, is comprised of a static runway comprised of four rectilinear sections 1, 2, 3 and 4, parallel two by two, determining a squared rectangular trajectory.

The said runway channelises the displacement in a closed circuit of a plurality of moulds 5 occupying the totatility of the circuit, with the exception of the spaces 6 of two diagonally opposed angles of the runway.

The contour of the said moulds 5 is quadrangular and the surface thereof is a sub-multiple of the surface of the closed circuit, and their vertices 7 are beveled determining a better guiding of the moulds between the channeling collateral guide sections 8 of the runway. Further, said bevelled vertices of the moulds determine, close to two of them, vertical angular channels 9 enabling operation of the feelers 10 which control the centering of each mould, mainly placed in the field of action of the presses 11 and 12.

The runway, at the head of each rectilinear section, is provided with pushers 13, respectively joined to opposite buffers 14 disposed at the tail end of each rectilinear section of the circuit.

The said buffers and pushers function alternatively two by two, so that the buffers and the pushers of the parallel sections of the runway will function synchronously, and those of the adjacent sections will not function until the former are inoperative, whereafter the pushers and the buffers of the other parallel sections will initiate functioning.

Each pusher 13 is actuated by a hydraulic or pneumatic cylinder 215, having a stroke equal to or greater than the corresponding dimension of a mould, so that its actuation determines the displacement of the mould and the entire alignment of moulds placed in front of the mould receiving the direct push.

The said alignment of moulds, in its displacement along the corresponding rectilinear section, is received at the opposite end by the buffer 14 which is actuated by a pneumatic cylinder 16, joined to a pressure regulator, the buffer and the opposite pusher being moved simultaneously to receive the corresponding mould to the end of its stroke.

At the said end of stroke, the pressure of the mould on the buffer determines the retraction of the buffer, contrary to the adjusted pressure of its cylinder, which return activates a microswitch which will function ordering the return of the corresponding antagonic pusher and the synchronizing of the remaining pushers and buffers.

Thus, the actuation of the opposite pusher and the buffer of two parallel rectilinear sections of the runway determines the intermittent movement of each mould which passes through the various operative phases for the manufacture of flat bodies.

The sliding base of the moulds of the static runway is comprised of parallel fixed guides, not represented in the drawings, on which the moulds 5 are displaced by the actuation of the pushers and in which intermittent displacement the moulds are channelised by the collateral guides 8.

The moulds, in their intermittent displacement along the rectilinear sections of the runway, pass through an initial filling phase of a first layer of material. Thus, the runway is provided, at the rectilinear sections 1 and 3, with a first material metering device.

Each of the metering devices is composed of a fixed hopper 17 mounted on columns 18 disposed at one side of the runway. Beneath the fixed hopper is positioned a displaceable carriage 19 by guides 20 arranged orthogonally to the corresponding rectilinear sections 1 and 3 of the runway.

The said carriage is displaceable reciprocally by the action of a hydraulic or pneumatic cylinder 21, and comprises a sector of its flat surface 22 which closes the outlet of the fixed hopper during the displacing movement.

At the platform of the carriage is disposed the inlet for materials to a metering or collecting hopper 23, mounted on the carriage and displaceable therewith.

The outlet of said metering or collecting hopper is closed, at its loading position, by the blank space 24 of a bridge plate 25 mounted on the runway.

One part of the said bridge plate is provided with grated openings 26 coinciding with the spaces 27 of the moulds.

Said spaces 27 of the moulds are the spaces for forming the flat pieces and are closed by independent bottoms 28.

The contour of the said bottoms of the moulds, which are made of steel, can be provided with a seal or retainer to prevent the liquid from being discharged when filling it with the material.

When the mould is inoperative, during the filling phase, the said bottom is capable of being vertically elevated by the action of conventional hydraulic elements 29 (see FIG. 3), by means of which movement the filling of the spaces 27, in which the pieces are formed, is regulated The said bottoms are joined to the columns of the elevating elements by electromagnetic means 30, identical to those represented in FIG. 3.

All this is so disposed that at two opposed points of the runway, two moulds will be filled with a first layer of material by the corresponding metering devices.

This filling will take place by means of the displacement of the carriage on the bridge plate 25, the material metering or collecting hopper of which discharges said material through the grated openings 26 of the bridge plate, which communicate with the spaces 27 of the mould, whose bottom 28 has been adjusted by the vertical displacement to a determined height inside the space, to form the first layer of material which will configure the visible face of the formed pieces.

During their travel in the closed circuit, the two moulds filled with this first layer of material will pass through a second material filling area positioned respectively at the initiation of the rectilinear sections 2 and 4.

At the said sections of the runway there is a second material metering device which fills the moulds with a second layer of material to conform the pieces.

This second metering device has the same configuration as the first, determined by a fixed hopper which discharges the material on a collector or metering hopper mounted on a displaceable carriage.

The carriage, at this section, is usually displaced in the same direction as the moulds, since normally the fixed hopper is disposed transversally on the runway as a bridge.

Likewise, the collector or metering hopper of this second filling device will discharge the material into the grated openings of a bridge plate positioned on the runway, which will coincide with the spaces of the mould, to carry out this second filling of the spaces of the moulds with material.

After the second metering device positioned on the rectilinear sections 2 and 4, the moulds filled with this second layer of material pass through the respective pressing zones 11 and 12 positioned on said rectilinear sections of the runway.

At the said pressing zones there is disposed, forming a bridge on the runway, a pressing device, the head of which incorporates the same number of plates as spaces 27 in the mould 5 or pieces to be formed.

All this is disposed in such a manner that when the pressing head is lowered by conventional hydraulic or pneumatic means, the plates will be inserted respectively in the spaces 27 of the mould, pressing the material which had been metered in two layers and forming the same amount of tiles or flat bodies as spaces of the mould.

At the outlet of the said presses, on the rectilinear sections 2 and 4 are positioned the respective pneumatic devices for extracting the finished pieces.

Each extracting device has a vacuum-effect multiple suction head 31 (FIG. 3). which head is partitioned by internal baffles 32 into as many suction chambers 33 as pieces to be extracted from the mould.

Said suction head is combined with the elevation of the bottoms of the mould, which will elevate by the said hydraulic or pneumatic means 29, the finished pieces to the said extracting head. When the pieces elevated by the corresponding bottoms contact the suction head, it contracts, activating the microswitches 34.

These microswitches actuate a cylinder which acts on a distributing device, not represented in the drawings, which causes the centrifugal suction pump to communicate with the air aspiration duct 35 reaching the suction head.

Through the lower holes 36 of each compartment of the suction head, there will be produced the suction of the pieces supported by the bottoms of the mould, which were in their most elevated position.

When the pieces are coupled to the extracting head, this is displaced outwards from the runway through the guides 37 along which the bearings 38 of the said head slide.

The said head, at its maximum stroke, reaches the position of the table 88 where the pieces are stacked, and which incorporates a loading pallet.

The said table along with the pallet contacts the pieces extracted by the head, so that upon contact the head contracts, the microswitches of the head being re-activated.

Upon activation of the microswitches, the aspiration, previously opened by the distributor, will be closed and the pieces are deposited on the loading pallet.

The said table is capable of effecting a vertical ascending and descending movement, and thus it is joined to its base by means of two scissors like interengaging levers 39 and 40, the unfolding or folding of which is determined by the actuation of a hydraulic cylinder 41.

When the pieces have been deposited on the loading pallet disposed on the table, this table descends controlled by the cylinder to the position of another loading of pieces which will be desposited forming a pile on those initialy loaded.

Thus, the table will descend with each load of pieces, since the arms of the lever will be folded by the action of the hydraulic device.

Likewise, the runway comprises, at the two rectilinear sections 2 and 4, next to the extracting devices, mould cleaning devices formed of brushes which move in a transversal direction to the passage of the empty moulds.

To clean the bottoms, these would have been elevated by the system indicated in FIG. 3 so that they are at the level of the surface of the moulds, wherefore the cleaning brushes can function.

Once the moulds have been cleaned, they will continue their intermittent movement until they reach, in a closed circuit, the rectilinear sections 1 and 3, at which point a new operating cycle will commence.

I claim:

1. Machine for manufacturing flat bodies in a continuous linear process comprising, a closed circuit static sliding runway having four interconnected rectilinear sections connected together to form a rectlinear closed circuit, each rectilinear section having a head end and a tail end which is opposite from the head end, a plurality of substantially quadrangular moulds each having at least one space for receiving material to form a piece to be molded, each space having a bottom for supporting the material, said moulds having dimensions which comprise a sub-multiple of the length of each rectlinear section with all rectilinear sections being completely filled with moulds except for opposite corners of said runway, each mould having bevelled vertices which, with the bevelled vertices of an adjacent mould in the runway form an angular vertical channel, feelers operatively connected to said runway for engagement in said angular vertical channels to center each mould on at least two of said rectilinear sections at a location corresponding to a press site where material in the space of each mould is to be pressed, a pusher mounted at the head end of each rectilinear section, each pusher having a cylinder with a stroke which is at least equal to a dimension of moulds in the rectangular section serviced by that pusher, for pushing all moulds in the rectangular section serviced by that pusher, for pushing all moulds in that rectangular section in a linear passage along that rectangular section, a buffer mounted at the tail end of each rectangular section and cooperating with the pusher of that rectangular section for receiving moulds pushed by the pusher, each rectangular section having its own pusher plus buffer pair, each buffer having a cylinder for withdrawing the buffer as the cylinder of the pusher extends the pusher for synchronizing movement of the pusher plus buffer pairs for moving the moulds along the rectangular sections in the linear passage, and a microswitch operatively connected to each of the cylinders of the pusher plus buffer pairs for activating a cylinder plus buffer pair which is downstream of a previously activated pusher plus buffer pair after the moulds of the previous pusher plus buffer pair have been moved along their respective rectangular section.

2. Machine for manufacturing flat bodies in a continuous linear process according to claim 1, including at least one fixed hopper having an outlet and being on the linear passage of the moulds a carriage mounted beneath the fixed hopper for reciprocal movement, a metering hopper with an outlet connected to the carriage and having a flat surface parallel to the movement of the carriage which acts as a closure for the fixed hopper, projected below the outlet of the fixed hopper, the runway incorporating at least one fixed bridge plate per hopper, which bridge plate has a blank part and a part provided with grated openings which coincide with the spaces in which the pieces are formed of each mould, the blank part of the bridge plate constituting means for closing the outlet of the metering hopper of the carriage and the part including the grated openings constituting means for distributing the material fed to the piece forming spaces, in the reciprocal movements of the metering hopper of the carriage, precisely in combination with the ascending and descending of the bottom of the spaces of each mould in which the pieces are formed.

3. Machine for manufacturing flat bodies in a continuous linear process according to claim 1 characterised in that the pneumatic device for extracting the finished pieces, disposed at the outlet of each press, has a vacuum-effect multiple suction head for the pieces, precisely partitioned internally by baffles which distribute the vacuum-effect according to the pieces to be extracted, and which functions in combination with an air distributor and with a vertical elevating table, below the maximum outlet point of the extracting carriage, the end elevation of the said table, in the form of a scissors, is controlled and contracts the suction head which, by means of a microswitch, orders the pieces to be placed on the table, established by the action of the distributor.

4. Machine for manufacturing flat bodies in a continuous linear process according to claim 3, wherein the bottoms of each mould comprise steel bottoms which move with the moulds as they move in the linear passage along the closed circuit runway, hydraulic elements operatively connected to the bottoms for moving the bottoms vertically in their respective moulds for receiving material to be filled into the spaces of the moulds, and electromagnet means connected to the hydraulic elements for electromagnetically attracting the bottoms to hold the bottoms to the hydraulic elements for movement of the bottoms vertically.

* * * * *

UNITED STATES PATENT OFFICE

CERTIFICATE OF CORRECTION

Patent No. 4,710,122 Dated December 1,1987

Inventor(s) Eliso Herrando Villanueva

It is certified that error appears in the above-identified patent and that said Letters Patent are hereby corrected as shown below:

Title page:

Inventor's name should read Eliso Herrando Villanueva in full

Signed and Sealed this

Third Day of May, 1988

*Attest:*

DONALD J. QUIGG

*Attesting Officer*

*Commissioner of Patents and Trademarks*

UNITED STATES PATENT OFFICE

CERTIFICATE OF CORRECTION

Patent No. 4,710,122 Dated December 1, 1987

Inventor(s) Eliseo Herrando Villanueva

It is certified that error appears in the above-identified patent and that said Letters Patent are hereby corrected as shown below:

Title page:

The correct name of the inventor is as follows:

Eliseo Herrando Villanueva

This certificate supersedes Certificate of Correction issued May 3, 1988.

Signed and Sealed this

Twenty-third Day of August, 1988

*Attest:*

*Attesting Officer*

DONALD J. QUIGG

*Commissioner of Patents and Trademarks*